US008444339B2

(12) United States Patent
Zhao et al.

(10) Patent No.: US 8,444,339 B2
(45) **Date of Patent: *May 21, 2013**

(54) APPARATUS HAVING A SLIDABLE CAP

(75) Inventors: Feng Zhao, Ningbo (CN); Weiying Chen, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,536

(22) Filed: Mar. 5, 2012

(65) Prior Publication Data

US 2012/0163896 A1 Jun. 28, 2012

Related U.S. Application Data

(63) Continuation of application No. 12/562,100, filed on Sep. 17, 2009, now Pat. No. 8,128,302.

(30) Foreign Application Priority Data

Sep. 17, 2008 (CN) ..... 2008 2 0138016 U
Apr. 9, 2009 (CN) ..... 2009 1 0134845

(51) Int. Cl.
*B43K 7/12* (2006.01)

(52) U.S. Cl.
USPC ..... 401/117; 401/91; 401/107; 401/202; 401/213; 401/243

(58) Field of Classification Search
USPC ..... 401/6, 91, 117, 202, 213, 243–247, 401/262, 269
See application file for complete search history.

(56) References Cited

U.S. PATENT DOCUMENTS

| | | | | |
|---|---|---|---|---|
| 928,312 | A * | 7/1909 | Lloyd | 401/117 |
| 2,416,112 | A * | 2/1947 | Moore | 401/107 |
| 3,741,665 | A * | 6/1973 | Smagala-Romanoff | 401/117 |
| 4,459,059 | A | 7/1984 | Greenspan | |
| 4,896,983 | A | 1/1990 | Im | |
| 6,382,860 | B1 * | 5/2002 | Kim | 401/104 |
| 8,128,302 | B2 * | 3/2012 | Zhao et al. | 401/117 |

* cited by examiner

*Primary Examiner* — Tuan N Nguyen
(74) *Attorney, Agent, or Firm* — Christensen O'Connor Johnson Kindness PLLC

(57) ABSTRACT

An apparatus comprises a body that extends longitudinally between a top end and a bottom end, an elongate slot disposed in an outer surface of the body and having first and second spaced-apart detents, and a cap disposed coaxially around the body and having a cut therein that defines an elongate arm. The elongate arm has an inwardly-oriented protrusion configured to engage the detents of the slot. The cap is slidable along the body such that the inwardly-oriented protrusion slides along the slot until it detachably engages a detent, thereby retaining the cap in either a closed position that covers the bottom end or an open position in which the bottom end is exposed.

17 Claims, 8 Drawing Sheets

APPARATUS HAVING A SLIDABLE CAP

BACKGROUND

Currently, there are many writing instruments, for example, ball-point pens, known in the art that have bodies and caps that are separable from each other. Normally, when a writing instrument is used for writing, its cap has to be removed from the writing end of the instrument. Separating a cap from the body of a writing instrument is inconvenient and increases the chances that the cap will be lost. A loss of a cap often results in discarding the writing instrument, which causes unnecessary waste.

Therefore, there remains a need to provide a writing instrument that has a cap that does not separate from the body of the instrument, which would effectively prevent the cap from being lost, and at the same time would sufficiently cover the writing end of the writing instrument when desired.

SUMMARY

The following summary is provided to introduce a selection of concepts in a simplified form that are further described below in the Detailed Description. This summary is not intended to identify key features of the claimed subject matter, nor is it intended to be used as an aid in determining the scope of the claimed subject matter.

An apparatus, which may be a writing instrument, has a slidable cap that is retained on a body of the apparatus. In at least one embodiment, the apparatus comprises a body that extends longitudinally between a top end and a bottom end. The body includes an elongate slot that is longitudinally disposed in an outer surface of the body. The slot has a first detent and a second detent, wherein the second detent is spaced apart from the first detent. The apparatus further includes an open-ended cap disposed coaxially around the body and configured to slide along the body.

The cap has a cut therein that defines an elongate arm having a protrusion that projects radially inward and is sized to engage the first and second detents. The protrusion is slidable within the slot until the protrusion detachably engages the second detent which retains the cap in a closed position in which the cap covers the bottom end of the body. The protrusion is further slidable within the slot until the protrusion detachably engages the first detent which retains the cap in an open position in which the bottom end of the body is exposed. In embodiments where the apparatus comprises a writing instrument in the form of a pen, the apparatus may include an ink cartridge disposed inside the body, In an embodiment, the cap may comprise a first portion having the elongate arm and a second portion extending axially from the first portion and being recessed from the first portion. The cap may further comprise a tubular part slidably disposed on the second portion and sized such that a surface of the tubular part is flush with a surface of the first portion when the tubular part is in contact with the first portion. The tubular part includes an elongate clip extending from a side of the tubular part and elastically connected to the tubular part. The clip includes an inwardly-oriented protrusion that engages the elongate arm such that the elongate arm is biased inward.

In another embodiment, the apparatus comprises a body extending longitudinally between a top end and a bottom end, wherein the body includes an elongate track having a first detent spaced apart from a second detent. The apparatus further comprises a cap disposed coaxially around the body. The cap is configured to slide along the body, and has a cut therein that defines an elongate arm. The elongate arm has an inwardly-directed protrusion that is slidable along the track. The protrusion may detachably engage the second detent which retains the cap in a closed position in which the cap is positioned around the bottom end of the body. The protrusion is further slidable along the track until the protrusion detachably engages the first detent which retains the cap in an open position in which the bottom end of the body is exposed.

In an embodiment, the elongate track comprises a slot that is longitudinally disposed in an outer surface of the body. The inwardly-directed protrusion on the elongate arm may be configured to engage the sides of the slot when the cap is in transition between the open and closed positions.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
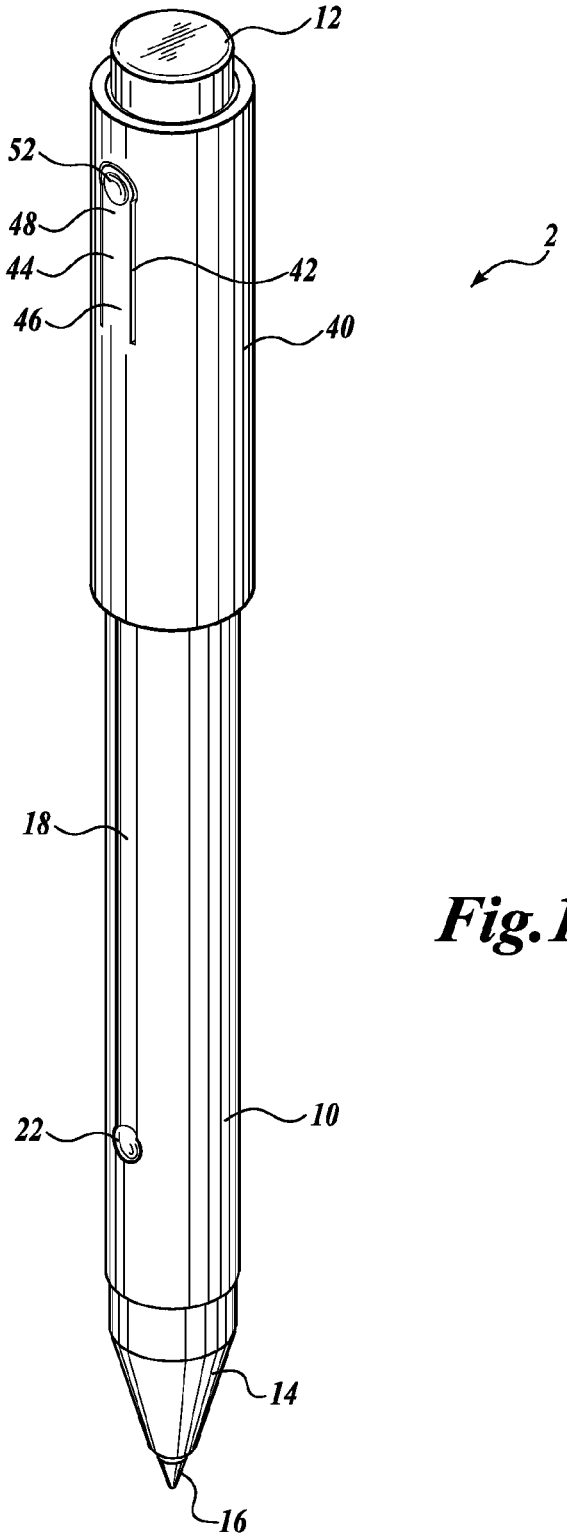
FIG. 1 is an upper front right perspective view of one embodiment of a writing instrument having a slidable cap in an open position.

FIG. 1 illustrates an embodiment of a writing instrument 2 having a slidable cap 40. The writing instrument 2 has a body 10, which includes a top 12 and, a writing end 14. An ink cartridge or ink well (not shown) is typically disposed inside the body 10 and delivers ink to a writing tip 16. In one embodiment, the writing end 14 comprises a ball-point writing tip 16. One skilled in the art will recognize that any type of writing end with any form of writing tip may be used in the writing instrument 2.

Figure 2:
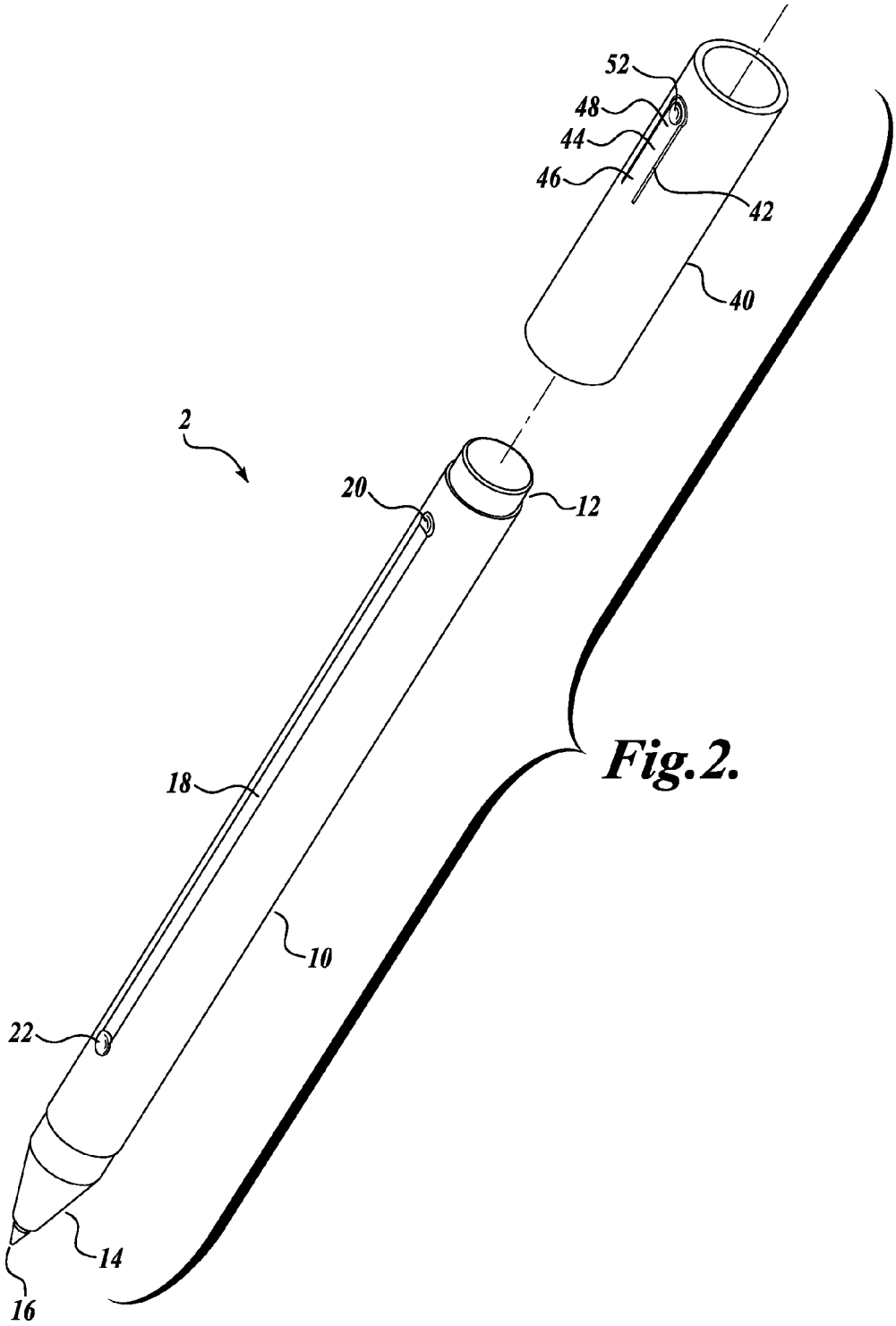
FIG. 2 is an exploded view of the writing instrument shown in FIG. 1.

An elongate slot 18 is defined longitudinally in the surface of the body 2 as shown in FIG. 1. The slot 18 extends from near the top 12 of the writing instrument to near the writing end 14. The slot has detents 20 and 22 defined at each end of the slot 18, as best seen in FIG. 2, which illustrates an exploded view of the writing instrument 2. The detents 20 and 22 may take different shapes, as described below in greater detail, but generally provide an indented space in the body 10 of the writing instrument.

Figure 4:
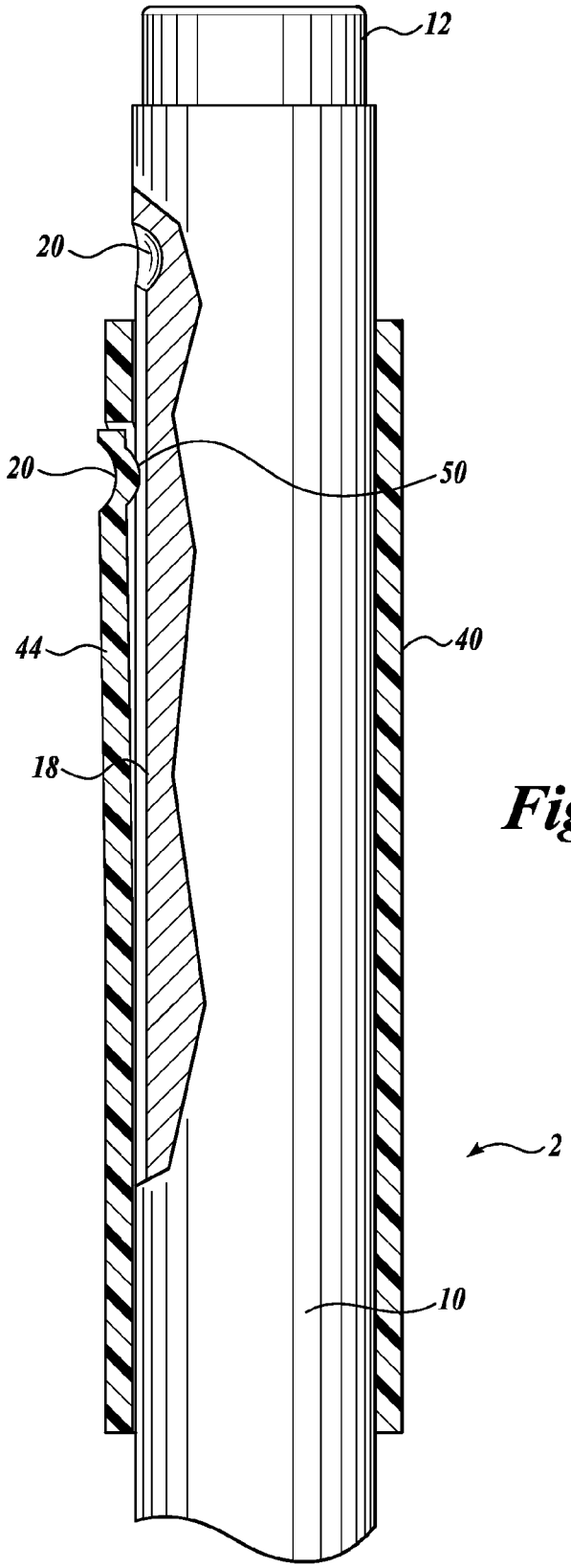
FIG. 4 is a cross-sectional view of the writing instrument shown in FIGS. 1 and 2 with the slidable cap in transition between the open and closed positions.

With continued reference to FIGS. 1 and 2, a substantially tubular open-ended cap 40 is disposed on the body 10 of the writing instrument 2. In the embodiment shown, the cap 40 has a cut 42 therein, which defines an elongate arm 44. In at least one embodiment, the cut 42 is substantially U-shaped. The elongate arm 44 is attached to the cap 40 at its first end 46 and elastically bends with respect to the cap 40 at the first end 46. The elongate arm 44 has an inwardly oriented protrusion 50 at its second end 48 as best seen in FIG. 4, which illustrates a cross-sectional view of the writing mechanism 2 shown in FIGS. 1 and 2. The protrusion 50 is sized to engage the detents 20 and 22 at each end of the slot 18. The detents 20 and 22, in turn, are configured to receive the protrusion 50. For example, in one embodiment, the protrusion 50 is ball-shaped, and the detents 20 and 22 are made round-shaped in order to best receive and engage the protrusion 50.

In one embodiment, when the protrusion 50 engages a detent 20 or 22, an outer surface of the elongate arm 44 becomes substantially flush with an outer surface of the cap 40. One skilled in the art will appreciate that the protrusion 50 and the detents 20 and 22 may take different shapes as long as the detents are shaped to generally receive a particular shape of the protrusion 50.

In one embodiment, the elongate arm 44 includes a depression 52 on its outer surface. The depression 52 may follow the general contour of the protrusion 50 on its inner surface, as illustrated in FIGS. 1-3 and best seen in FIG. 4.

Figure 3A:
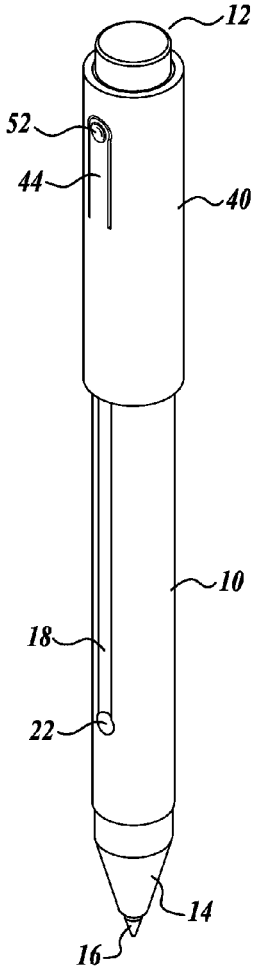
FIGS. 3A, 3B, and 3C illustrate the writing instrument shown in FIGS. 1 and 2 as the slidable cap is moved from the open position to a closed position.
Figure 3B:
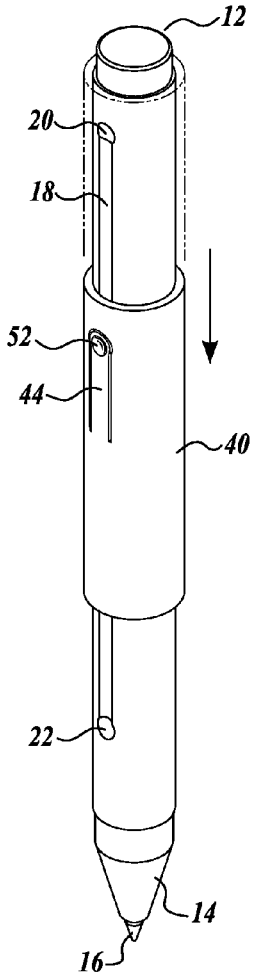
Figure 3C:
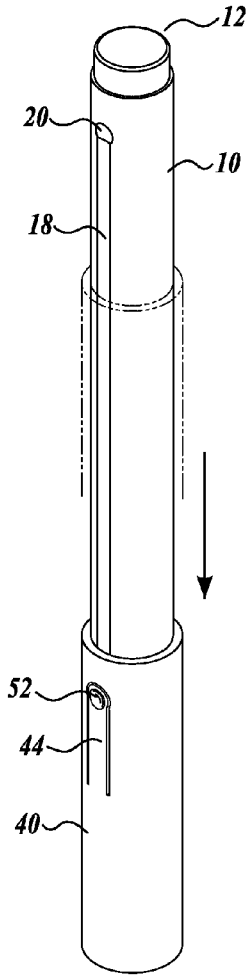

The operation of the writing instrument 2 having a slidable cap 40 as shown in FIGS. 1 and 2 is illustrated in FIGS. 3A-3C. As shown in FIG. 3A, the cap 40 is in an open position where the cap 40 is disposed proximate to or near the top 12 of the writing instrument 2 and the protrusion 50 is engaged in the detent 20. When a downward coaxial force is applied to the cap 40, the protrusion 50 lifts out of the detent 20, slightly bending the elongate arm 44, and slides along the opposite sides of the slot 18. The cap 40 slides from the open position shown in FIG. 3A along the body as shown in FIG. 3B to the closed position shown in FIG. 3C. In the closed position, the detent 22 receives the protrusion 50 and the elongate arm 44 returns to a position that is substantially flush with the surface of the cap 40. In at least one embodiment as illustrated in FIG. 4, the protrusion 50 engages the sides of the slot 18 during the transition shown in FIG. 3B such that the cap 40 slides along the slot 18 without having freedom to rotate around the body 10 of the writing instrument 2. When the protrusion 50 engages the detent 22, the cap 40 is retained in the closed position such that the cap 40 covers the writing end 14, as shown in FIG. 3C.

Similarly, if an upward force is applied to the cap 40 to cause the cap to slide from the closed position covering the writing end 14 of the instrument 2 toward the open position at the top 12, the protrusion 50 lifts out of the detent 22, slightly bending the elongate arm 44, and the cap 40 slides along the slot 18 until the protrusion 50 engages the detent 20, which causes the cap 40 to be retained in the open position near the top 12 of the writing instrument 2. In the open position, the writing end 14 is exposed and the writing instrument 2 is ready to be used.

FIGS. 5-8 illustrate another embodiment of a writing instrument with a slidable cap.

Figure 5:
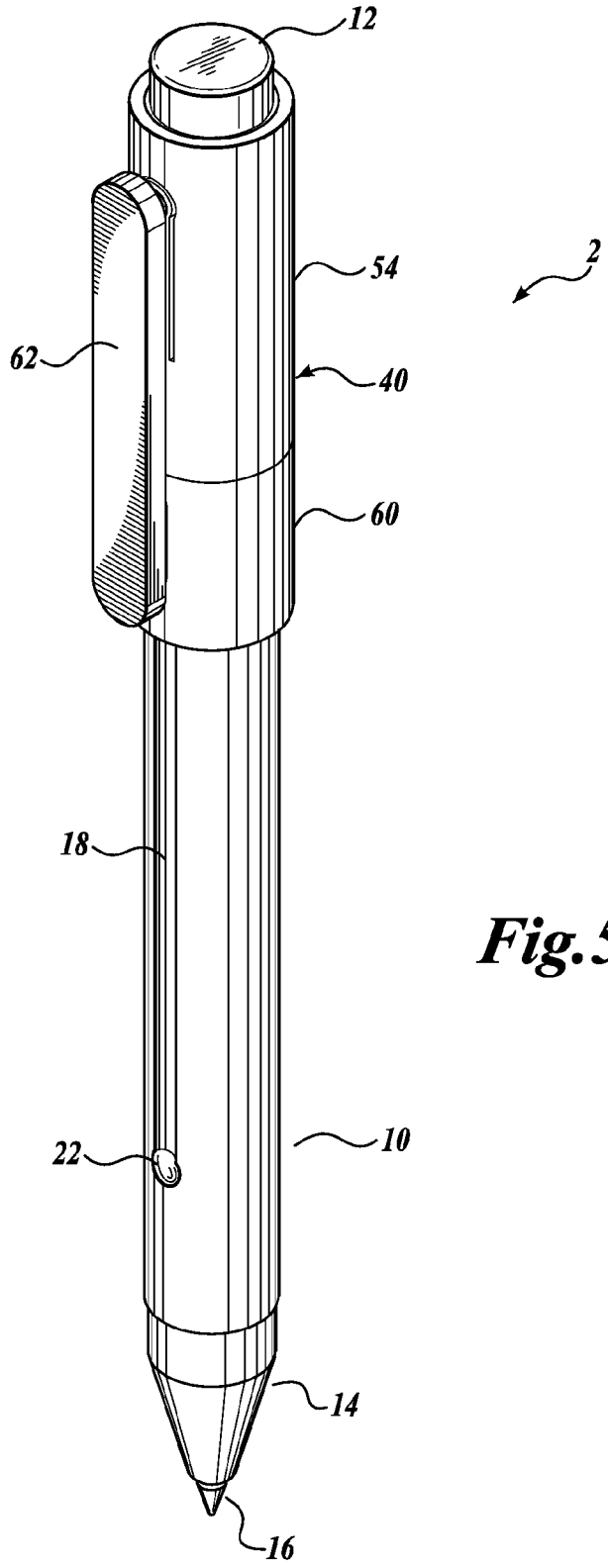
FIG. 5 is an upper front right perspective view of another embodiment of a writing instrument having a slidable cap in an open position.
Figure 6:
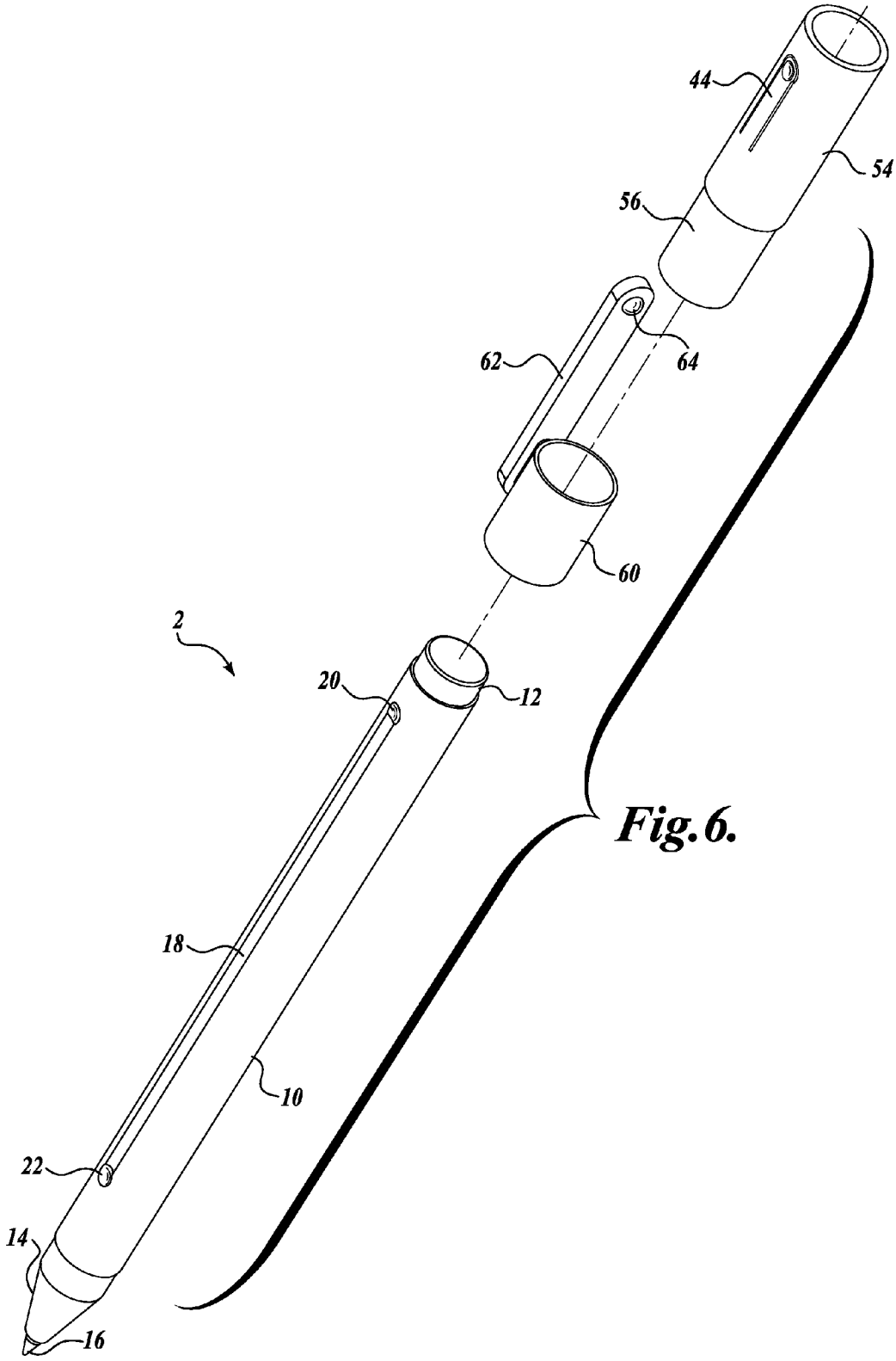
FIG. 6 is an exploded view of the writing instrument shown in FIG. 5.

As best seen in FIG. 6, the cap 40 comprises a first portion 54 that has an elongate arm 44, similar to the embodiment described above in regard to FIGS. 1-4, and a second portion 56 that extends axially from the first portion 54 and is inwardly recessed from the outer surface of the first portion 54. The cap 40 further comprises a tubular part 60 that is slidably disposed on the second portion 56 of the cap 40. In one embodiment, the outer diameter of the tubular part 60 matches the outer diameter of the first portion 54 such that when the tubular part 60 is disposed on the second portion 56 and is adjacent to the first portion 54, the outer surface of the tubular part 60 is substantially flush with the outer surface of the first portion 54, as shown in FIG. 5.

Figure 8:
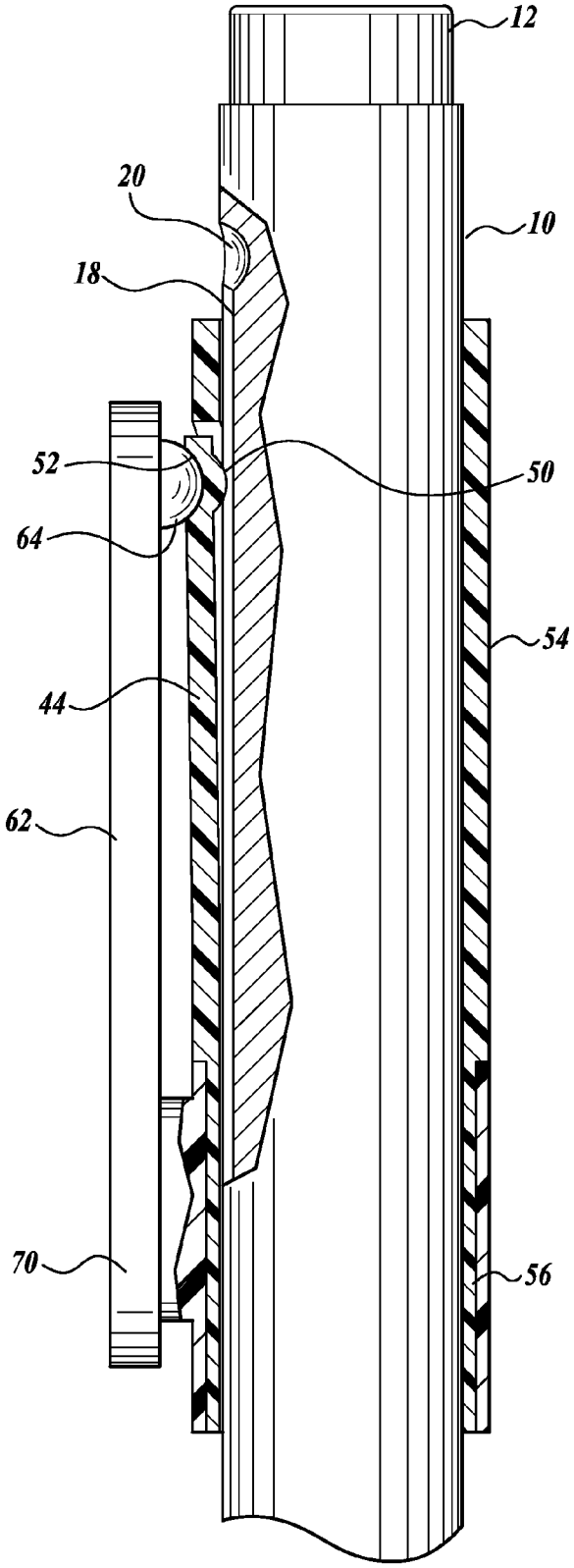
FIG. 8 is a cross-sectional view of the writing instrument shown in FIGS. 5 and 6 with the slidable cap in transition between the open and closed positions.

As illustrated in FIG. 8, the tubular part 60 includes an elongate clip 62 that is connected to the tubular part at one end 70. At the other end of the clip 62, the clip has an inwardly-oriented protrusion 64. In at least one embodiment, the protrusion 64 is sized to engage the depression 52 on the elongate arm 44. Similar to the embodiment of FIGS. 1-4, the protrusion 50 of the elongate arm 44 may be shaped in a variety of shapes, in one instance, a ball, and the detents 20 and 22 of the slot 18 may be sized and shaped to receive the protrusion 50. For example, if the protrusion 50 is shaped as a ball, the detents 20 and 22 may be round-shaped.

When the inwardly-oriented protrusion 64 of the elongate clip 62 engages the depression 52 on the elongate arm 44, the elongate clip 62 may help bias the elongate arm 44 inward, as described below.

Figure 7A:
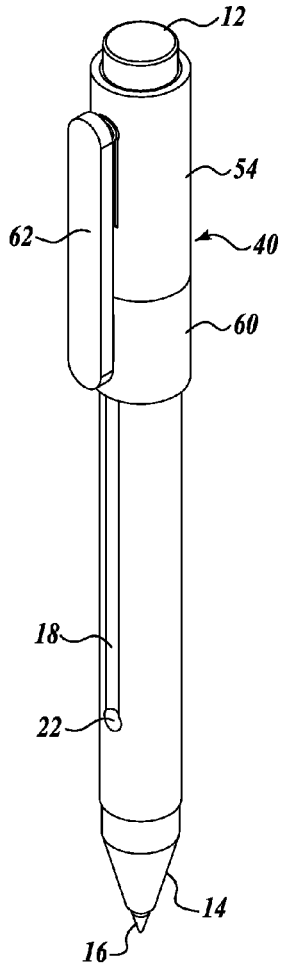
FIGS. 7A, 7B, and 7C illustrate the writing instrument shown in FIGS. 5 and 6 as the slidable cap is moved from the open position to a closed position.
Figure 7B:
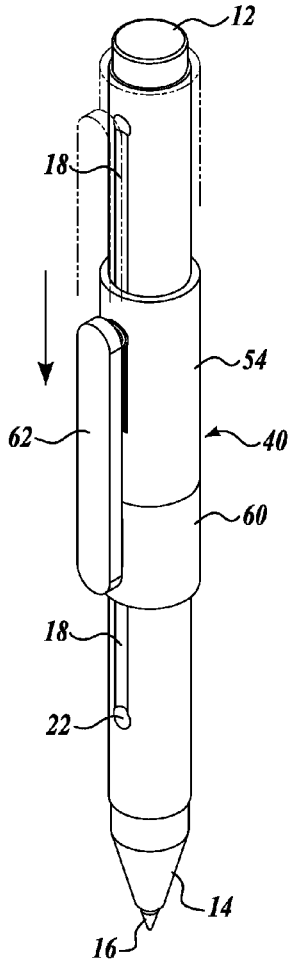
Figure 7C:
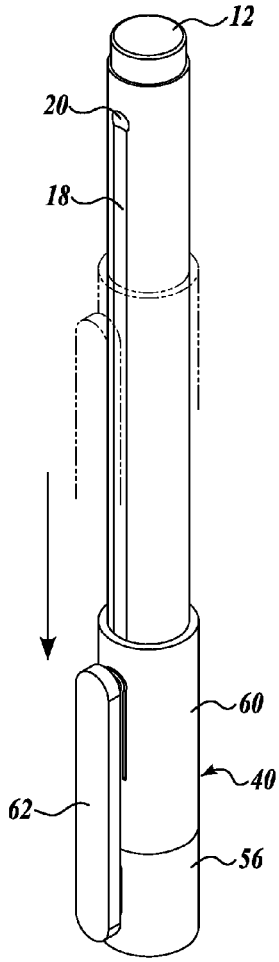

The operation of the embodiment of the writing instrument in FIGS. 5 and 6 is similar to that shown in FIGS. 1 and 2 and described above, and is illustrated in FIGS. 7A-C. As shown in FIG. 7A, when a downward coaxial force is applied to the cap 40, the protrusion 50 lifts out of the detent 20, slightly bending the elongate arm 44 and the clip 62, and slides in contact with sides of the slot 18. The cap 40 slides along the body, as seen in FIG. 7B, from the open position shown in FIG. 7A to the closed position as shown in FIG. 7C. In the closed position, the detent 22 receives the protrusion 50 and the elongate arm 44 returns to a position that is substantially flush with the surface of the cap 40. The clip 62 also returns to a non-deflected position. In at least one embodiment as illustrated in FIG. 8, the protrusion 50 engages the sides of the slot 18 such that the cap 40 slides along the slot 18 without having freedom to rotate around the body 10 of the writing instrument 2.

When the protrusion 50 engages the detent 22, the cap 40 is retained in the closed position such that the cap 40 covers the writing end 14, as shown in FIG. 7C. As illustrated in FIG. 8, the protrusion 64 of the elongate clip 62 engages the depression 52 of the elongate arm 44. In this configuration, the clip 62 is constructed to help inwardly bias the elongate arm 44, thereby causing the protrusion 50 to engage with the detent 22 and retain the cap 40 in the closed position, covering the writing end 14 of the instrument 2. One skilled in the art will appreciate that while in the closed position illustrated in FIG. 7C, the clip 62 may also be used to clip the writing instrument 2 to a user's pocket, notebook, or such like.

Similarly, if the cap 40 is caused to slide from the closed position at the writing end 14 of the instrument 2 toward the open position at the top 12, the protrusion 50 will slide along the slot 18 until it engages the detent 20 and the cap is arrested in the open position at the top 12 of the writing instrument 2. In the open position, the writing end 14 is exposed and the writing instrument 2 is ready to be used.

While various illustrative embodiments have been illustrated and described, it will be appreciated that various changes can be made therein without departing from the spirit and scope of the invention.

The invention claimed is:

1. An apparatus, comprising:

a body extending longitudinally between a top end and a bottom end, wherein the body includes an elongate slot that is longitudinally disposed in an outer surface of the body, the slot having a first detent and a second detent, the second detent being spaced apart from the first detent;

an open-ended cap disposed coaxially around the body and configured to slide along the body, wherein the cap has a cut therein that defines an elongate arm having a first end and a second end, wherein the first end of the arm is connected to the cap, and wherein the second end of the arm is not connected to the cap and is able to flex away from the cap, wherein the elongate arm has a protrusion at the second end that projects radially inward and is sized to engage the first and second detents, the elongate arm further including a depression on its outer surface at the second end proximate to the protrusion, wherein the protrusion is slidable within the slot until the protrusion detachably engages the second detent which retains the cap in a closed position in which the cap covers the bottom end of the body, and wherein the protrusion is further slidable within the slot until the protrusion detachably engages the first detent which retains the cap in an open position in which the bottom end of the body is exposed; and a clip having an inwardly-oriented protrusion that engages the depression on the elongate arm and thereby inwardly biases the second end of the arm, wherein when the cap is in transition between the open and closed positions, the second end of the arm and the clip together flex outward, away from the body of the apparatus.

2. The apparatus of claim 1, wherein the apparatus comprises a writing instrument, and wherein the bottom end of the body includes a writing end of the writing instrument.

3. The apparatus of claim 1, wherein the first end of the elongate arm is configured to elastically bend with respect to the cap.

4. The apparatus of claim 1, wherein when the cap is in the open or closed position, an outer surface of the arm is substantially flush with an outer surface of the cap.

5. The apparatus of claim 1, wherein the clip extends from an outer surface of the apparatus.

6. The apparatus of claim 1, wherein the cap comprises a first portion and a second portion, and wherein the first portion includes the elongate arm and the second portion extends axially from the first portion and is inwardly recessed from an outer surface of the first portion.

7. The apparatus of claim 6, wherein the cap further comprises a tubular part that is slidably disposed on the second portion, and wherein the tubular part includes the clip, wherein the inwardly-oriented protrusion of the clip engages the depression on the elongate arm when the tubular part is disposed on the second portion adjacent to the first portion.

8. The apparatus of claim 1, wherein the cut in the cap has substantially parallel sides that extend longitudinally along at least a portion of the cap.

9. The apparatus of claim 1, wherein the slot has sides, and wherein the inwardly-oriented protrusion on the elongate arm is configured to engage the sides of the slot when the cap is in transition between the open and closed positions.

10. An apparatus, comprising:

a body extending longitudinally between a top end and a bottom end, wherein the body includes an elongate track having a first detent spaced apart from a second detent;

a cap disposed coaxially around the body and configured to slide along the body, wherein the cap has a cut therein that defines an elongate arm having a first end and a second end, wherein the first end of the arm is connected to the cap, and wherein the second end of the arm is not connected to the cap and is able to flex away from the cap, wherein the elongate arm has an inwardly-directed protrusion at the second end that is sized to engage the first and second detents, wherein the protrusion is slidable along the elongate track until the protrusion detachably engages the second detent which retains the cap in a closed position in which the cap is positioned around the bottom end of the body, and wherein the protrusion is further slidable along the elongate track until the protrusion detachably engages the first detent which retains the cap in an open position in which the bottom end of the body is exposed; and a clip configured to inwardly bias the second end of the elongate arm via an inwardly-oriented protrusion that engages the elongate arm, wherein when the protrusion of the elongate arm slides along the elongate track between the first and second detents, the second end of the arm and the clip together flex outward, away from the body of the apparatus.

11. The apparatus of claim 10, wherein the elongate track is a slot that is longitudinally disposed in an outer surface of the body.

12. The apparatus of claim 11, wherein the slot has sides, and wherein the inwardly-directed protrusion on the elongate arm is configured to engage the sides of the slot when the cap is in transition between the open and closed positions.

13. The apparatus of claim 10, wherein the apparatus comprises a writing instrument, and wherein the bottom end of the body includes a writing end of the writing instrument.

14. The apparatus of claim 10, wherein the first end of the elongate arm is configured to elastically bend with respect to the cap.

15. The apparatus of claim 10, wherein the cut in the cap has substantially parallel sides that extend longitudinally along at least a portion of the cap.

16. The apparatus of claim 10, wherein the elongate arm further includes a depression on its outer surface at the second end proximate to the inwardly-directed protrusion.

17. The apparatus of claim 16, wherein the inwardly-oriented protrusion of the clip engages the depression on the elongate arm and thereby inwardly biases the second end of the elongate arm.

* * * * *